US005433685A

United States Patent [19]

Winslow et al.

[11] Patent Number: 5,433,685

[45] Date of Patent: Jul. 18, 1995

[54] EXERCISE APPARATUS AND METHOD OF USING SAME

[75] Inventors: Jeffrey S. Winslow, 10626 Aderman Ave., #12, San Diego, Calif. 92126; Lonnie C. Pogue, San Diego; Richard A. Roshon, Olivenhain, both of Calif.

[73] Assignee: Jeffrey S. Winslow, San Diego, Calif.

[21] Appl. No.: 237,683

[22] Filed: May 4, 1994

Related U.S. Application Data

[62] Division of Ser. No. 78,442, Jun. 15, 1993, Pat. No. 5,336,152.

[51] Int. Cl.[6] ..... A63B 21/068

[52] U.S. Cl. ..... 482/96; 482/52; 482/132; 482/139

[58] Field of Search ..... 482/52, 96, 131, 132, 482/139, 148, 908; 606/240; 280/32, 32.6; 601/23, 115, 122

[56] References Cited

U.S. PATENT DOCUMENTS

| | | | |
|---|---|---|---|
| 2,699,953 | 1/1955 | Chaddick | 280/32 |
| 2,733,922 | 2/1956 | Diego | 482/96 |
| 4,700,945 | 10/1987 | Rader | 482/132 |
| 5,096,186 | 3/1992 | Wilkinson et al. | 482/52 |
| 5,226,865 | 7/1993 | Chin | 482/52 |
| 5,263,913 | 11/1993 | Boren | 482/96 |

*Primary Examiner*—Richard J. Apley
*Assistant Examiner*—Jeanne M. Clark
*Attorney, Agent, or Firm*—Bernard L. Kleinke; Peter P. Scott

[57] ABSTRACT

An exercise kit, and a method of using it, which includes an exercise apparatus having a compact curved base member, which generally conforms to the shape of the back of a user, and a set of transverse rollers which are adapted to enable the base member to roll upwardly and downwardly over a wall or other such surface. A device enables the base member to be worn on the lower back of the user, who can press the rollers against a wall as the user performs various excercises, for enabling the leg muscles to be exercised in a comfortable, easy manner. The base member is also curved transversely to distribute pressure uniformly over a large area of the back to help reduce discomfort to the wearer. A pair of spaced apart transverse rollers for distributing pressure across a large area of a wall uniformly, each include an extruded thermoplastic member to help make the apparatus relatively inexpensive to manufacture, and light in weight. A guard disposed at a top portion of the base member helps to prevent the clothing of the user from inadvertently becoming entangled in the rollers during use. An adjustable stand used in conjunction with the exercise apparatus includes a removable platform which is supported above the floor to limit the downward movement of the user during a first exercise routine, and which is placed on the floor to engage the foot of the user during a second exercise routine.

4 Claims, 7 Drawing Sheets

EXERCISE APPARATUS AND METHOD OF USING SAME

CROSS-REFERENCE TO RELATED APPLICATIONS

This is a divisional application of application Ser. No. 08/078,442, filed Jun. 15, 1993, U.S. Pat. No. 5,301,152, and entitled "EXERCISE APPARATUS AND METHOD OF USING SAME."

TECHNICAL FIELD

The present invention relates in general to exercise apparatus, as well as a method for providing muscular conditioning. The invention more particularly relates to an exercise apparatus and method which enable a user to strengthen his or her leg muscles, without tending to cause unwanted and undesired muscle strain or soreness.

BACKGROUND ART

Exercise equipment for conditioning the leg muscles has existed in a variety of forms. The majority of such exercise equipment has been large, bulky, and expensive, and not intended to be easily stored and retrieved by the user. For example, reference may be made to U.S. Pat. Nos. 3,920,240; 4,176,836; 4,374,519; 4,700,945; 4,911,432 and 5,162,030.

Early attempts to provide a compact, inexpensive, and convenient exercise device, which is disclosed in U.S. Pat. No. 4,700,945, and which includes a platform adapted to be worn by the user and provided with a set of castors on the back surface of the platform to provide platform mobility. The user attaches the wheeled platform to his or her back, and then performs leg exercising maneuvers by causing the platform to move up and down rollably along a wall, as the user performs knee bends repeatedly, across a stationary surface, thereby exercising the thigh muscles of the user.

Although such an exercise device may be somewhat compact in size, it may not be entirely satisfactory for some applications. In this regard, the platform may be generally unstable due to the set of castors. It would appear that it may well be difficult for the user to maintain all four wheels in simultaneous engagement with the wall, as the device moved upwardly and downwardly repeatedly. The user may have to exert unnecessary and unwanted energy to steer the platform during the performance of an exercise routine.

Such an exercise device was not transported easily, nor was it stored easily. In this regard, the heavy castors or wheels and the associated mounting hardware added excessive weight and bulk to the device. Moreover, the castors could damage the surface of a wall, by scuffing or gauging it unintentionally.

Thus, it would be highly desirable to have a new and improved exercise apparatus, which maneuvered easily, and which is light in weight and relatively compact in size. Such a new and improved exercise apparatus should also move freely over an associated support surface such as a wall, without tending to mar or otherwise to damage it.

Another problem associated with the exercise device described in U.S. Pat. No. 4,700,945 relates to its back engaging platform. In this regard, the patented platform is substantially flat and engages only a portion of the lower back of the user. As a result, only portions of the platform could contact the back of the user due to the shape of the lower back. As a result, the pressure exerted on the back by the platform, would not be uniformly distributed, and thus the user could experience unwanted discomfort during exercising.

Therefore, it would be highly desirable to have a new and improved exercise apparatus, which is comfortable to use and which does not cause unnecessary back discomfort during use.

DISCLOSURE OF INVENTION

Therefore, it is a principal object of the present invention to provide a new and improved exercise apparatus and a method of using it, wherein the apparatus is compact in size, durable, light in weight and able to travel across an associated working surface, such as a wall, without tending to mar or otherwise to damage it.

Another object of the present invention is to provide such a new and improved exercise apparatus and a method of using it, wherein the apparatus is comfortable to use and does not tend to cause unwanted and undesired back discomfort to the user during use.

Briefly, the above and further objects of the present invention are realized by providing a new and improved exercise method and apparatus for exercising the legs of a user, in a convenient to use manner, which is comfortable to the user and does not tend to damage a supporting surface, such as a wall.

An exercise apparatus includes a compact curved base member, which generally conforms to the shape of the back of a user, and a set of transverse rollers which are adapted to enable the base member to roll upwardly and downwardly over a wall or other such surface. A device enables the base member to be worn on the lower back of the user, who can press the rollers against a wall as the user performs knee bends repeatedly, for enabling the leg muscles to be exercised in a comfortable, easy manner. The base member is also curved transversely to distribute pressure uniformly over a large area of the back to help reduce discomfort to the wearer. A pair of spaced apart transverse rollers for distributing pressure across a large area of a wall uniformly, each include an extruded thermoplastic member to help make the apparatus relatively inexpensive to manufacture, and light in weight. A guard disposed at a top portion of the base member helps to prevent the clothing of the user from inadvertently becoming entangled in the rollers during use.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
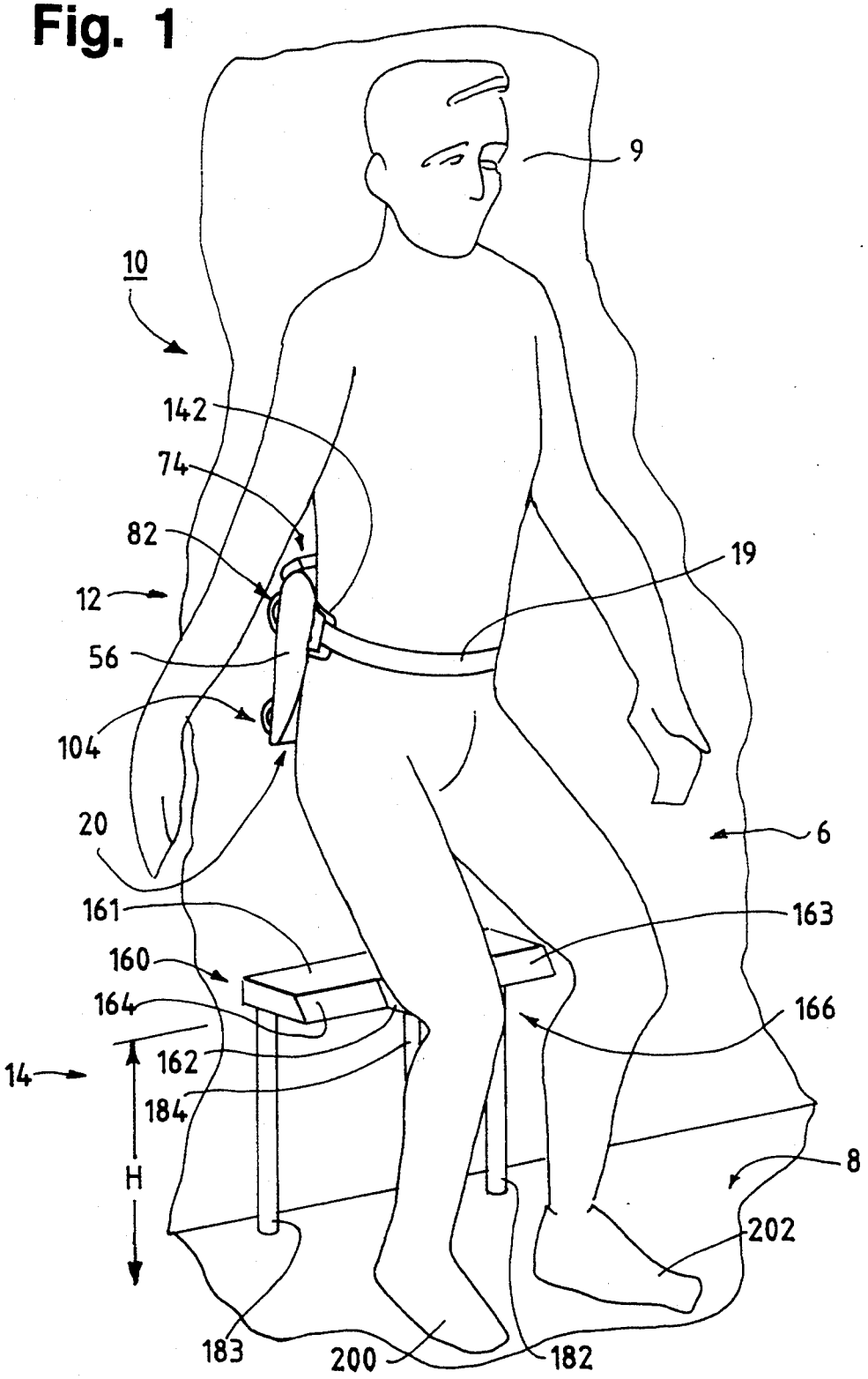
FIG. 1 is a pictorial view of exercise apparatus, which is constructed in accordance with the present invention, illustrating a user performing an exercise routine according to the method of the present invention.
Figure 6:
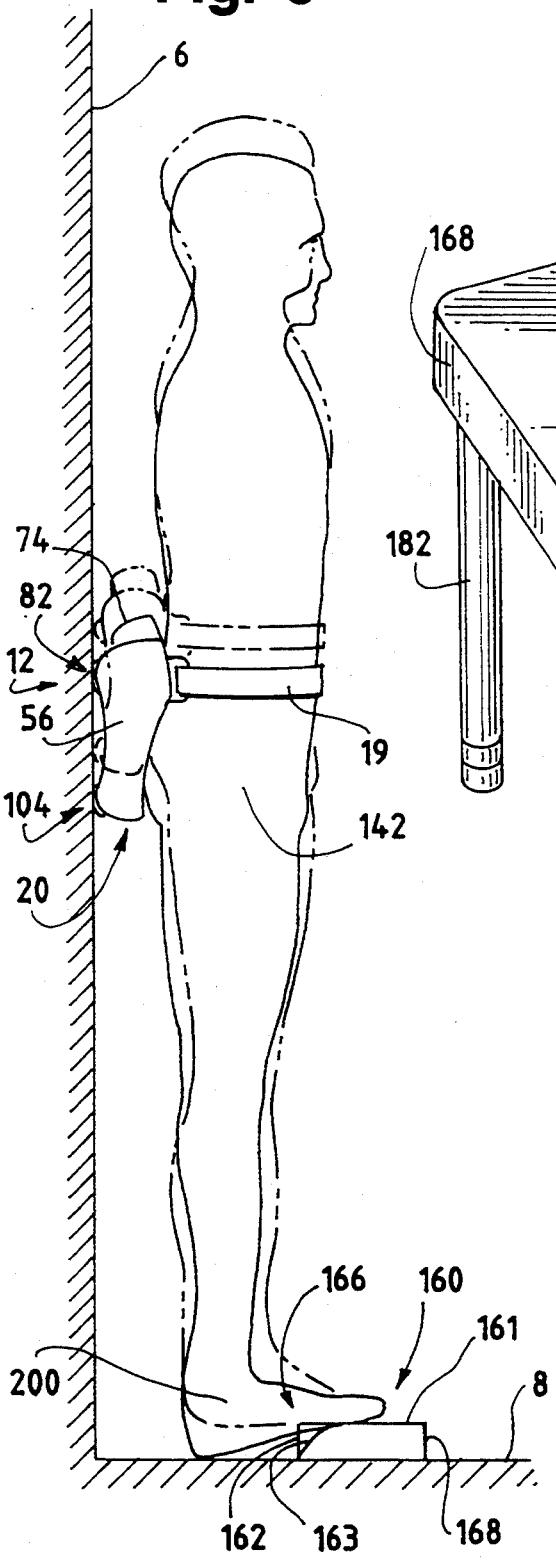
FIG. 6 is a pictorial, partially diagrammatic view of the apparatus of FIG. 1 illustrating another method of use thereof according to the present invention.
Figure 7:
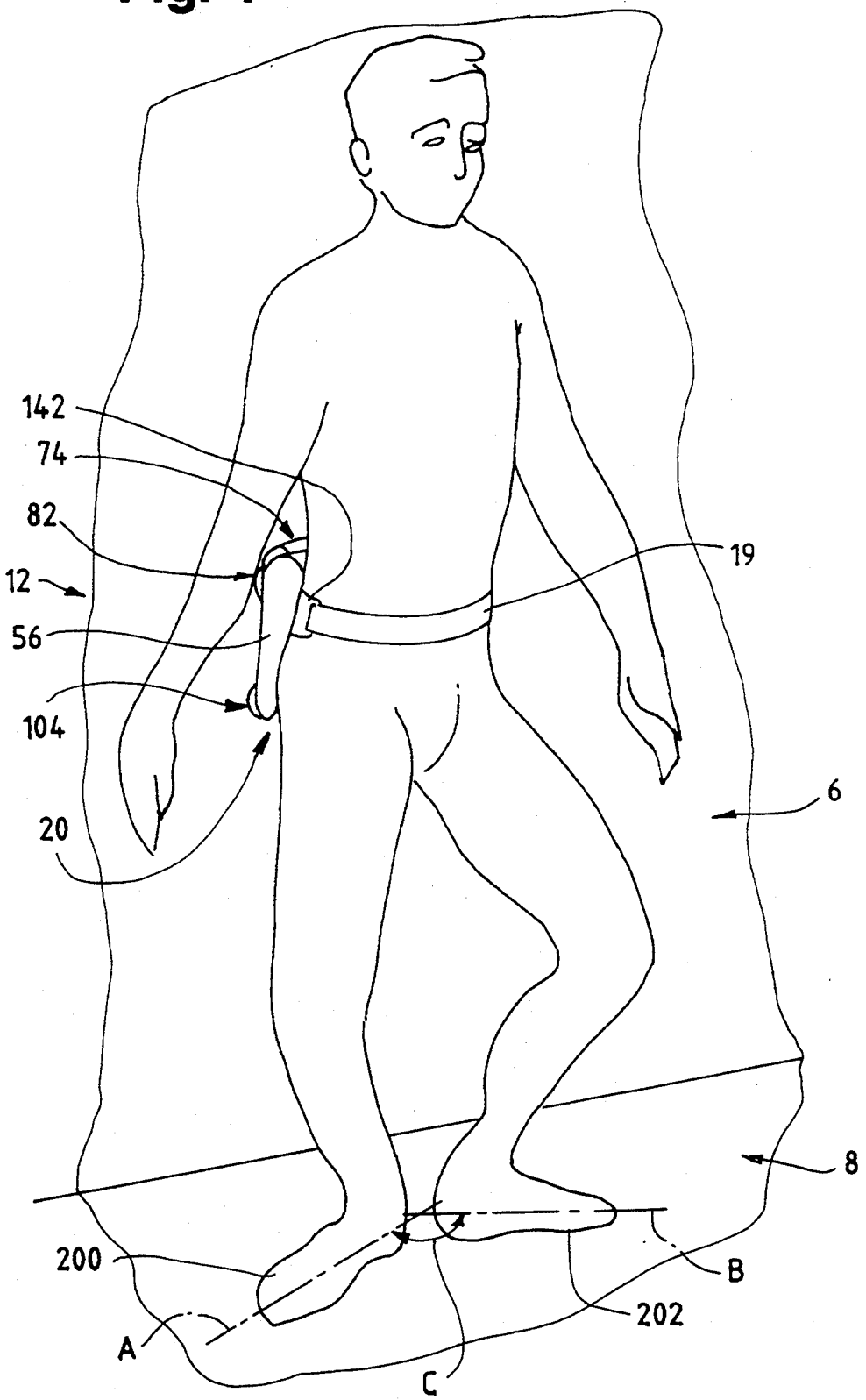
FIGS. 7 and 8 are greatly enlarged pictorial views, similar to FIG. 6, of the exercise apparatus of FIG. 1 during further different exercise methods according to the present invention.
Figure 8:
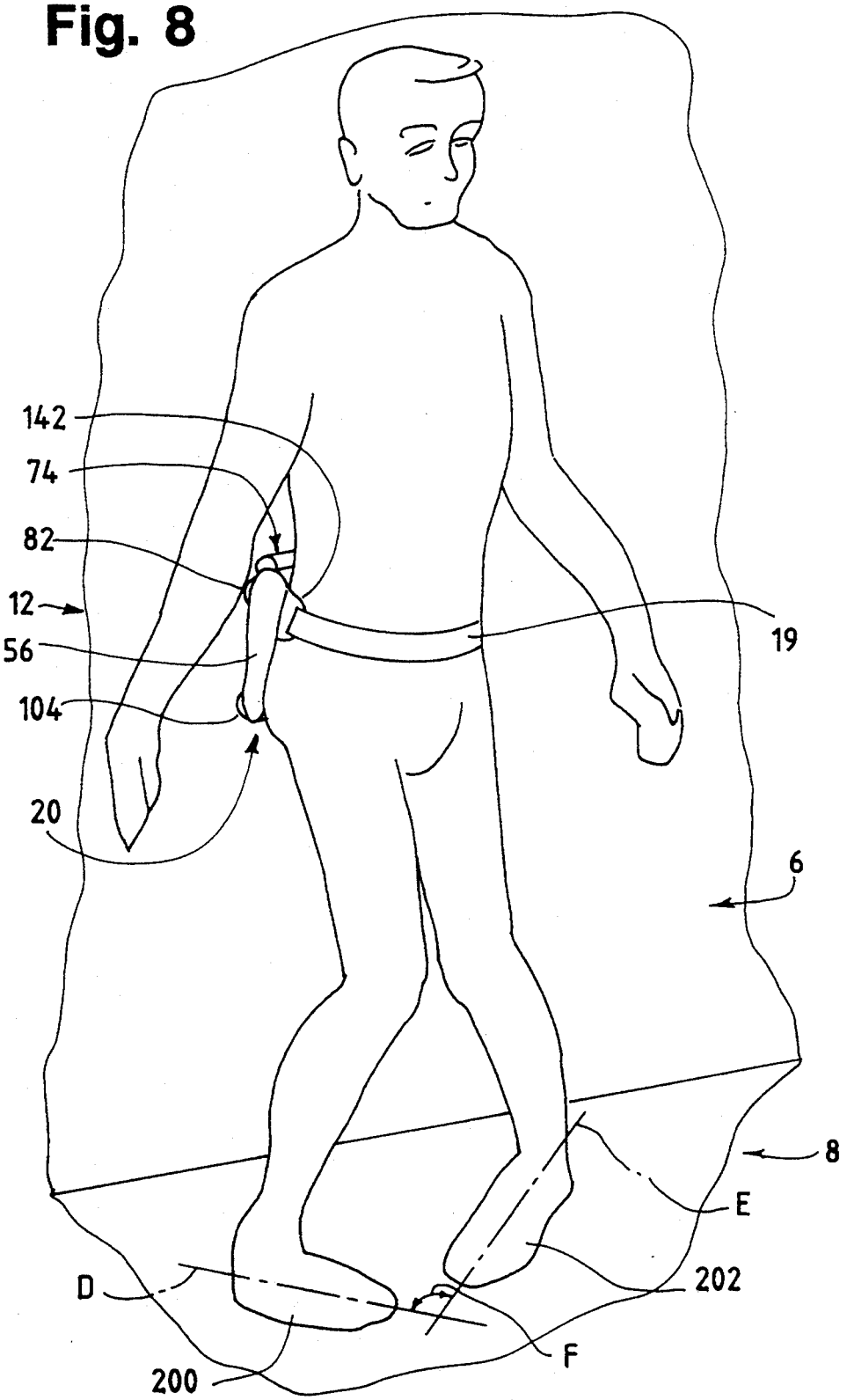

Referring now to the drawings, and more particularly to FIGS. 1–5 thereof, there is shown exercise apparatus 10, which is constructed according to the present invention. The apparatus 10 is a kit, generally comprising a waist mounted leg exercise device 12 for enabling the back of the user to roll upwardly and downwardly along a wall as the user performs knee bends. The apparatus 10 also includes an exercise platform or stop 14 adapted to rest on a suitable support surface, such as the ground or a floor 8, to either be used with its removably legs 182–184 to limit downward excursions of the user as indicated in FIG. 1, or be used without its legs as a platform for other exercises as indicated in FIGS. 6, 7 and 8. The exercise device 12 is worn at the waist on the lower back and buttock area of a user 9 to enable the user to engage a vertical surface, such as a wall 6, with the device 12, and the platform structure 14 is positioned adjacent to the wall 6 to facilitate the performance of various exercise methods of the present invention, as will be considered hereinafter in greater detail.

Figure 2:
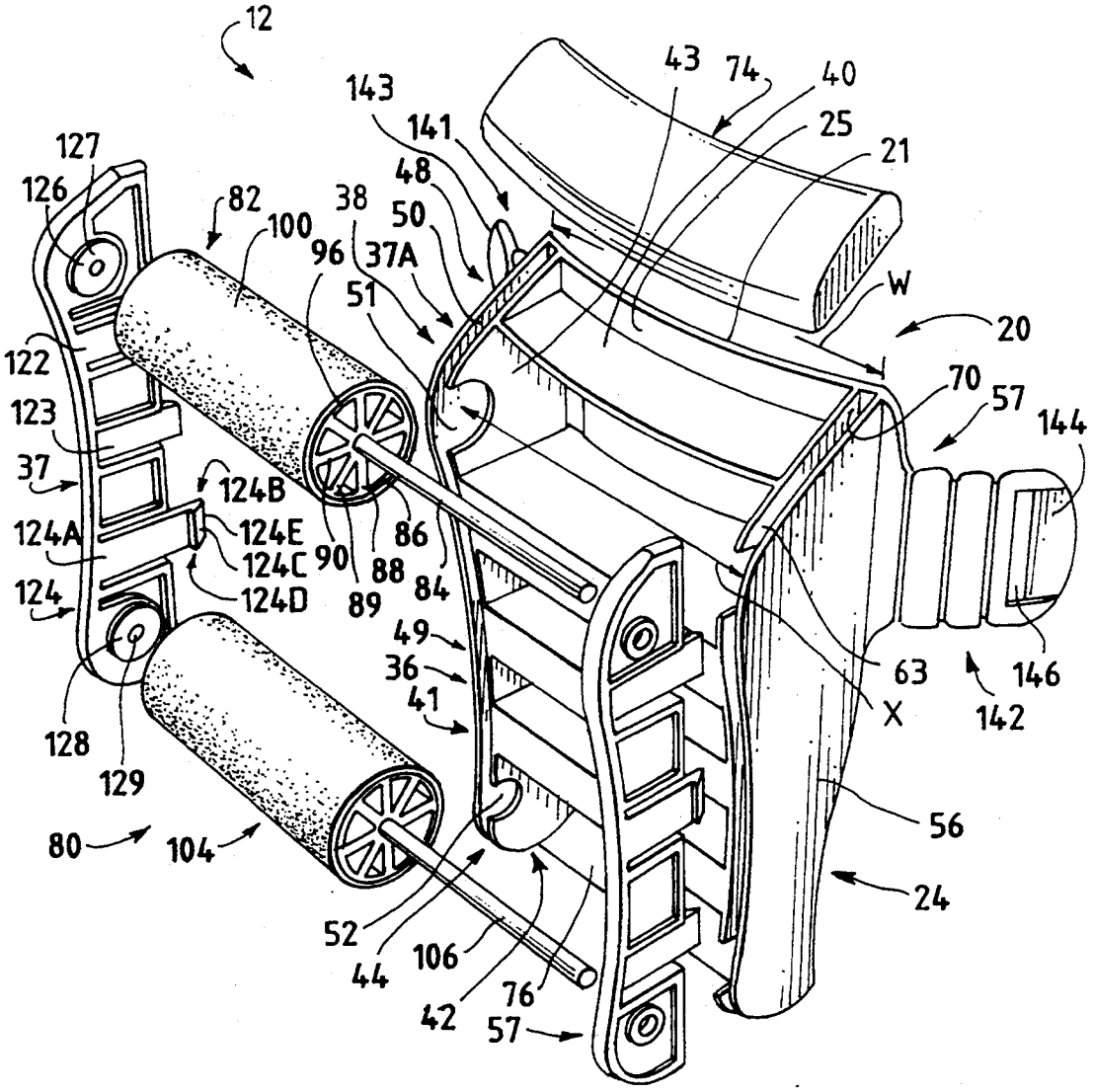
FIG. 2 is an enlarged exploded pictorial view of the waist mounted exercise device of the exercise apparatus of FIG. 1, illustrating the front, top and right side thereof.
Figure 3:
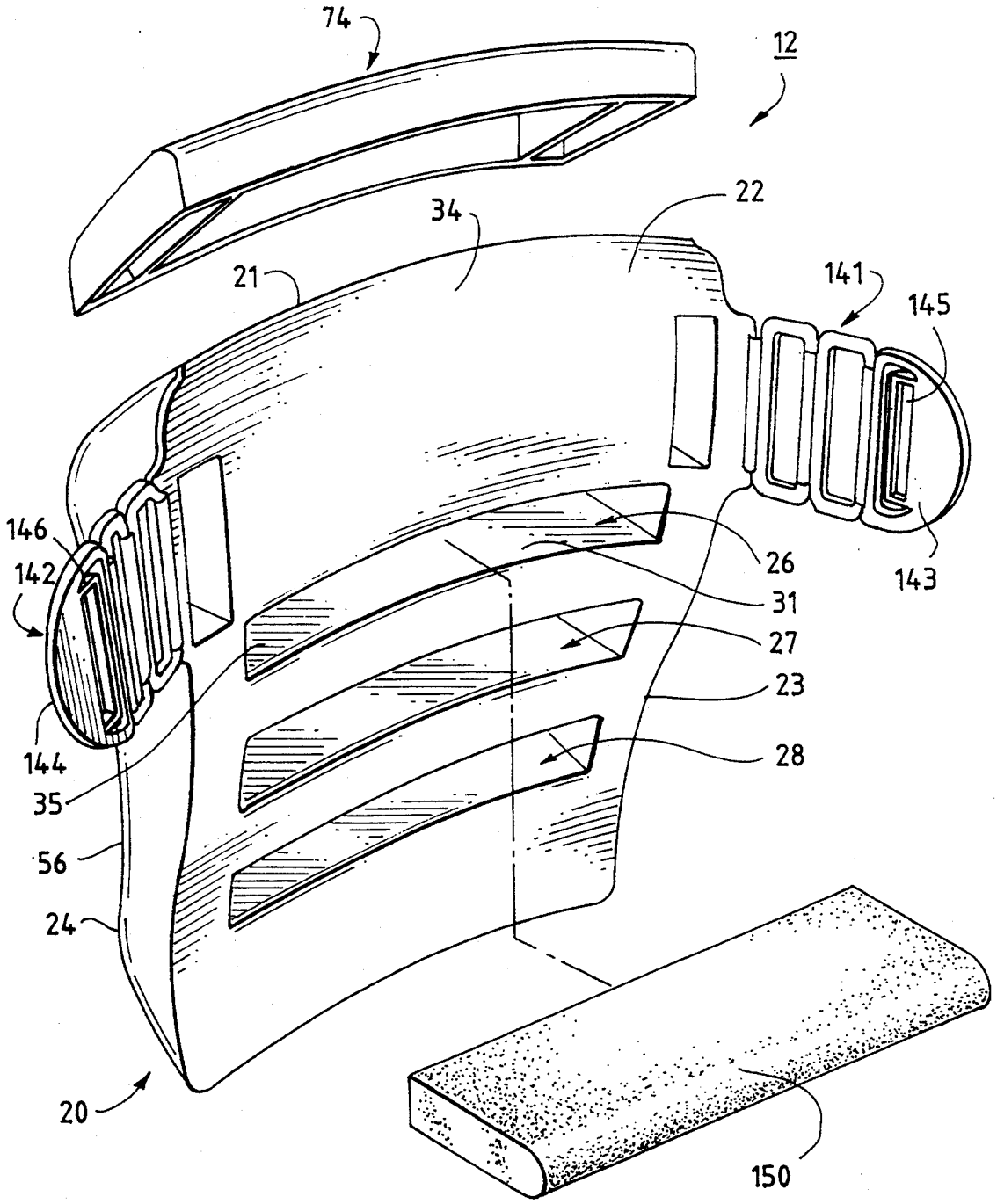
FIG. 3 is an exploded pictorial view of the waist mounted exercise device of FIG. 1, showing only one of a set of pads, the other two being omitted for sake of clarity, illustrating the rear and left side of the device.

As best seen in FIGS. 2 and 3, the leg exercise device 12 generally includes a base member 20 having a pair of integrally connected flexible strap members 141 and 142 which are adapted to receive a belt 19 (FIG. 1) for attaching the device 12 to the user 9. A roller assembly 80 having a pair of spaced apart elongated cylindrical rollers 82 and 104 is adapted to be secured to the base member 20. The rollers 82 and 104 enable the user 9 to move the base member 20 rectilinearly along the vertical wall 6 as will be described hereinafter in greater detail. A clothing guard 74 is secured to the base member 20 to prevent the clothing of the user 9 from becoming entangled with the rollers 82, 104.

In use, the exercise device 12 is strapped initially into engagement with the lower back and buttock area of the user 9. The user 9 then stands on the floor area 8 adjacent to the vertical wall 6, facing away from the wall 6. By leaning backward, the user 6 then engages the exercise device 12 with the wall 6. Once the exercise device 12 is so positioned, the user 9 may bend and straighten alternatingly his or her legs, thereby causing the exercise device 12 to travel down and up the wall 6, and thereby transporting the upper body of the user 9. In this manner, the body weight of the user 9 is used to exercise the leg muscles of the user simultaneously with the lower back area.

In one novel exercise method, the platform structure or stop 14 is placed behind and below the buttock area user. In this way, the platform structure 14 limits or stops the lower range of travel of the user, so that they cannot inadvertently bend the knee beyond a point where it becomes difficult to straighten them, without leaving the position next to the wall. Also, the amount of leg strength required can be lessened, by limiting the length of the path of travel of the user. Such a method permits the user having a limited amount of leg strength to exercise in a very safe manner.

From the foregoing, it will be understood by those skilled in the art, that the user obtains physical conditioning of his or her leg muscles as the exercise device 12 traverses the wall bi-directionally. To increase leg conditioning, the number of bending and extending repetitions may be repeated as often as desired.

Considering now the base member 20 in greater detail with reference to FIGS. 2 and 3, the base member 20 has a unitary construction and is comprised of a moldable thermoplastic material. In side elevation, the base member has a front wall member 22 for engaging the lower back and buttock area of the user. In this regard, the front wall member 22 has an upper convex configuration and a lower concave configuration, to be configured ergonomically to conform to the spinal curvature of a substantial cross section of the populace. The front wall member 22 is generally U-shaped transversely to conform to the lower back and hips of the user. A pair of side wall members, such as a left side wall member 36 and a right side wall member 56 are integrally connected at opposite sides of the front wall member 22. The side wall members 36 and 56 extend substantially perpendicular from the front wall 22.

A pair of inner wall members, such as a left inner wall member 43 and a right inner wall member 63 are integrally connected to a rear portion 25 of the front wall member. The inner wall members 43 and 63 are spaced apart from the side wall members 36 and 56 respectively and extend substantially perpendicularly outwardly from the rear portion 25 to define a pair of assembly receiving slots 50 and 70. In this regard, the slots 50 and 70 are adapted to receive the roller assembly 80 therein as will be described hereinafter in greater detail.

The left and right side wall members 36, 56 are separated by about a distance W. The left and right inner wall members 43, 63 are separated by about a distance X. From the foregoing, those skilled in the art will understand the width of each of the slots 50 and 70 is defined by $$\frac{W - X}{2}.$$

In order to prevent entanglement of the clothing of the user with the upper cylinder member 82, the guard member 74 is mounted at the top of the base member 20 adjacent the front wall member 22 between the two side wall members 36 and 56. The guard 74 is generally rectangular in shape and is supported from below by a platform 40 that extends between the inner wall members 43 and 63. The guard 74 is secured to the rear portion 25 and inner wall members 43 and 63 by means not shown.

As a result of the placement of the guard member 74 relative to the front wall 22, a gap 75 (FIG. 4) of about $\frac{1}{8}$ to $\frac{1}{2}$ is formed between the guard member 74 and upper cylinder member 82.

In order to prevent entanglement of the clothing of the user with the lower cylinder member 104, the base member 20 has a generally rectangular lower platform member 76 that is integrally connected to a lower portion 33 of the front wall 22 (FIG. 4), between the inner wall members 43, 63. The lower platform member 76 is dimensioned to form a gap 77 (FIG. 4) of about ⅛ to ½ between the lower platform member 76 and the lower cylinder member 104.

Considering now the roller assembly 80 in greater detail with reference to FIG. 2, the roller assembly 80 generally includes a left axle support member 37 and a right axle support member 57. The upper and lower cylinder members 82, 104 are mounted axially rotatably between the left and right axle support members 37 and 57 respectively. Cylinder members 82, 104 are spaced apart from one another along the longitudinal axis of the roller assembly 80 in a generally parallel manner. Each cylinder has a longitudinal length substantially equivalent to the transverse dimension X. In this manner, the force applied by the cylinder members 82,104 to the vertical wall 6 is distributed evenly across the width X of the exercise device 10 at two separated locations.

Figure 5:
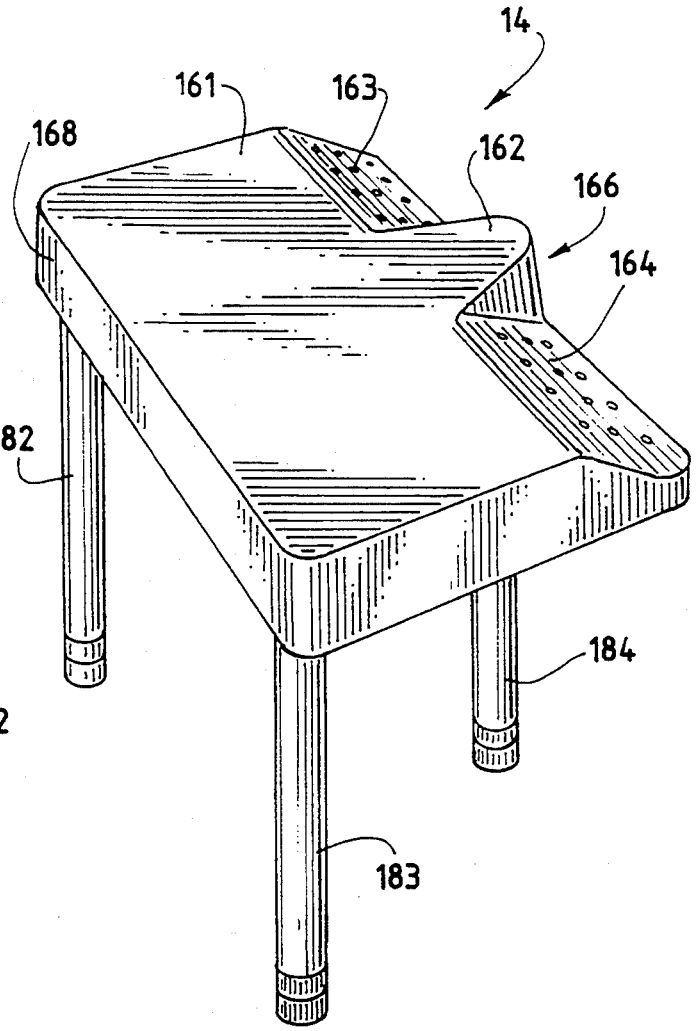
FIG. 5 is a greatly enlarged, pictorial view of a portion of the apparatus of FIG. 1, being used as a platform for the feet, to help perform another exercise according to the present invention.

Considering now the platform structure 14 in greater detail, with respect to FIGS. 1 and 5, the platform structure 14 generally includes a substantially flat top member 160 having a set of spaced apart threaded apertures (not shown) on the bottom surface of the top member 160. The top member 160 is supported from the floor 8 by a set of three leg members 182–184. Each leg member, such as leg member 182, includes a top threaded portion (not shown) which is adapted to engage one of the threaded apertures disposed in the top member 160.

The top member 160 is generally rectangular in shape having a top surface 161, and connected integrally thereto, a beveled front edge portion 166 and a rear edge portion 168. Rear edge portion 168 is substantially flat to enable the platform 14 to rest securely against the wall 6.

The length of each leg member, such as the leg member 182, is sufficiently long to enable the height H to be adjusted to between about 14" and about 17". In this manner, the user can set the length of the path of travel followed by the device 12 to accommodate the amount of leg strength required to move the device 12 up and down the wall 6 and to help prevent the user to descend too far downwardly where he or she can not recover and straighten the legs to return from a seated position to a standing position.

Considering now the platform structure 14 in still greater detail, the forward edge portion 166 slopes downwardly and away from top surface 161, to facilitate stabilization of the flat top member 160 when it is resting on the floor 8. Connected integrally to an intermediate portion of forward edge portion 166 is a tab member 162. Tab member 162 projects outwardly from forward edge 166 and divides forward edge portion 166 into two foot engageable portions 163 and 164. In this regard, as will be explained hereinafter, during another one of the exercise routines, the top member 160 is disconnected from its leg members 182–184 and is utilized as a platform or riser, while resting directly on the floor, for helping to facilitate other leg exercise techniques.

Figure 4:
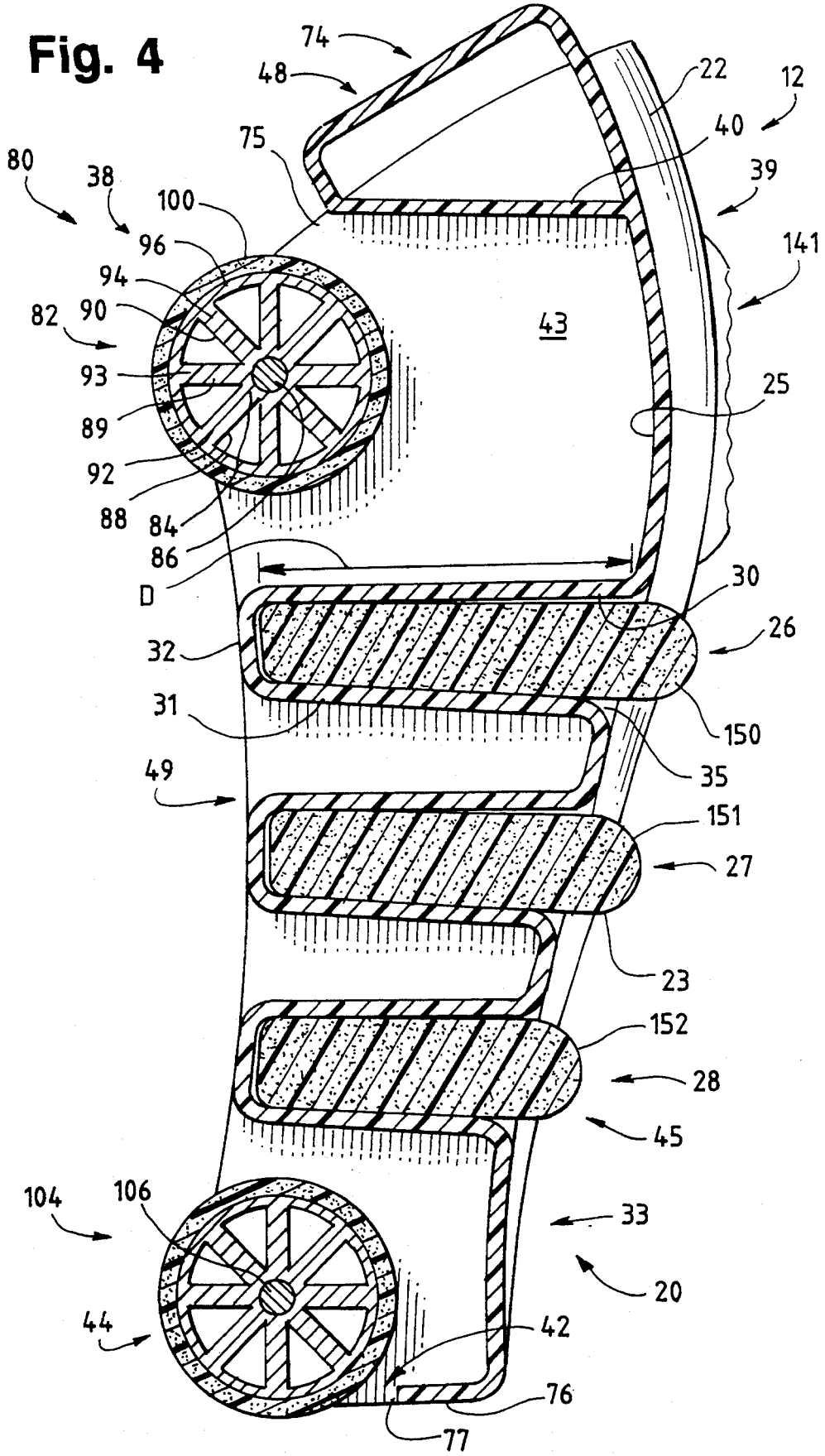
FIG. 4 is a further enlarged, sectional, partially broken away side elevational view of the exercise device of the apparatus of FIG. 1.

Considering now the front wall member 22 in greater detail, with reference to FIGS. 2–4, front wall member 22 is contoured in both the vertical and horizontal planes to generally correspond to the curves of the lower back area. To this end, the front wall member 22 includes a curvilinear left edge portion 23 and a curvilinear right edge portion 24 which define the shape of the front wall member 22 in the vertical plane. As the left edge portion 23 and the right edge portion 24 are substantially similar to one another, only the left edge portion 23 will be discussed in further detail.

As best seen in FIG. 4, the left edge portion 23 protrudes forwardly adjacent to an upper left side wall portion 32A and the left edge portion 23 protrudes rearwardly adjacent to a lower left side wall portion 41. The shape so defined by the left edge portion 23 is extended uniformly through a front wall central portion 34 to the right edge portion 24, thereby matching the front wall member 22 to the lower back area in the vertical plane.

In addition, the front wall member 22 is curved in the horizontal plane to further match the lower back area. As best seen in FIGS. 2 and 3, top edge 21 is bowed rearwardly so that left and right edge portions 23, 24 are forward of central portion 34.

Considering now the left and right side wall members 36, 56 in greater detail, with reference to FIGS. 2 and 4, only the left side wall member 36 will be discussed in greater detail as the two side wall members are substantially similar. Left side wall member 36 attaches to the front wall member left edge 23 along a substantially convex upper leading edge portion 39 and a substantially concave lower leading edge portion 45. Thus, front wall member 22 is reinforced in the desired contoured shape.

The left side wall member 36 generally includes a straight top edge portion 48 which is integrally connected to an upper curved edge portion 38. The opposite end of the curved edge portion 38 is integrally connected to rear edge portion 49. The opposite end of the edge portion 49 is integrally connected to a lower curved edge portion 44. A straight bottom edge portion 42 is intermediate the curved edge portion 44 and the rear portion 25.

The curved edges 38, 44 are rounded having a radius of curvature that is substantially larger than the radius of the cylinder members 82, 104. Thus, the cylinder members 82, 104 when engaged with the base member 20 extend beyond the periphery of the left and right side wall members 36, 56 to engage the wall 6 without damaging it, due to unwanted contact from the side wall members 36, 56.

Considering now the inner wall 43 in greater detail, relative to FIG. 2, the inner wall 43 generally includes an upper and a lower notch or cut-out portion 51, 52 which are dimensioned to receive the cylinder members 82 and 104 respectively for free rotative movement without contacting the left inner wall 43.

Considering now upper and lower cylinder members 82, 104 in greater detail, with reference to FIGS. 2 and 4, only upper cylinder member 82 will be described in greater detail as upper cylinder member 82 is substantially similar to lower cylinder member 104. The upper cylinder member 82 has a unitary construction and is extruded from a rigid thermoplastic material. The cylinder member 82 includes a central coaxial hub 86 to receive an axle 84 therein. Radiating outwardly from the hub 86 are a plurality of axial rib members, such as rib members 88–90, ending in rib member distal ends 92–94. An outer cylindrical rim member 96 is connected integrally to the distal ends 92–94 to complete the cylinder member 82.

By employing the extruded construction according to the present invention, the rollers are very light in weight, and are relatively inexpensive to manufacture. Moreover, due to the rib members, the rollers are able to withstand the necessary forces.

Attached to the entire outside surface of the outer cylindrical rim member 96 is a compressible but resilient sleeve member 100 having a low durometer, such as urethane. Sleeve member 100 may be manufactured from a urethane material and attached to the cylindrical rim member 96 by a heat shrinking process.

In order to retain the cylinder members 82,104 in a fixed, spaced apart orientation, axles 84 and 106, which support the respective cylinder members 82 and 104, are disposed parallel to one another and between the axle support members 37, 57 so that the axles 84, 106 are perpendicular to the axle support members 37, 57. The axle support members 37 and 57 are adapted for snapping engagement within the slots 50 and 70, respectively, as will be explained hereinafter.

Considering now the left and right axle support members 37, 57 in greater detail, with reference to FIG. 2, only left axle support member 37 will be considered in greater detail as left axle support member 37 is substantially similar to right axle support member 57.

Left axle support member 37 is dimensioned for sliding engagement within slot 50 and includes a plurality of spaced apart latch spring members, such as spring members 122–124, The spring members 122–124 interact latchably with associated slots (not shown) within the left side wall member 36 and the inner left wall member 43 to secure the left axle support member 37 within slot 50.

As each of the latch spring members 122–124 are substantially similar, only latch spring member 124 will be described in greater detail.

Latch spring member 124 as best seen in FIG. 2 has a unitary construction and is composed of a suitable resilient material such as a thermoplastic material, including a high impact type thermoplastic. The latch spring member includes a flat straight portion 124A which is integrally connected at one of its ends to an inner edge portion of the axle support member 37. The opposite end of the straight portion 124A is connected to a camming portion 124B which extends upwardly from the straight portion 124A. The camming portion 124B includes a ramping portion 124C and a raised step portion 124D. The opposite end of the camming portion 124B terminates in an end portion 124E.

Referring now to FIG. 2, as the roller support assembly 80 is inserted into slots 50 and 70, the latch spring members, such as latch spring member 124, will remain in an unstressed position as the assembly 80 is inserted into the slot 50. Subsequently, as the assembly 80 is properly positioned within the slots 50 and 70, the ramping portion of each spring member, such as the ramping portion 124C of the spring member 124 contacts the inner wall 43 and is moved cammingly outwardly. As the assembly 80 continues along its path of travel into the slot 50, the raised step portion 124D is moved beyond the slot in the inner wall 43 thus permitting the latch spring member 124 to move resiliently back to an unstressed position. In this regard, the raised step portion 124D snaps into the slot causing the latch spring member 124 to be secured to the base member 20.

In order to help properly align the left axle member 37 within slot 50, the left axle member 37 also includes a pair of inwardly directed generally circular projections or protuberances, such as an upper projection 126 and a lower projection 128.

The projections 126, 128 are dimensioned and positioned on the left axle support member 37 to be received within the cutouts or notches 51, 52 respectively of the inner wall member 43. Each of the projections 126, 128 include a centrally disposed hole, such as a hole 127 and a hole 129 respectively. Holes 127, 129 define axle bearing openings within the axle support member 37.

Considering now the front wall member 22 in still greater detail, with reference to FIGS. 3 and 4, the front wall member 22 includes a central section having a series of ridges and valleys for defining a plurality of pad receiving spaces, such as spaces 26–28. As each of the spaces 26–28 are substantially similar, only space 26 will be considered in further detail.

Space 26 is generally rectangular in shape and is defined by a pair of upper and lower wall members 30, 31 which are spaced apart by a back wall member 32. Wall members 30, 31 extend rearwardly and convergently a distance D from the front wall member 22, and define an opening 35 slightly larger than back wall member 32. The back wall member 32 is connected integrally between the upper and lower wall members 30, 31, thus defining the space 26.

In order to provide a comfortable supporting surface for the back of the user, the exercise device 12 also includes a plurality of support pad devices, such as support pad devices 150–152, to serve as cushions. The support pad devices 150–152 are received and retained within the spaces 26–28 respectively .

As pads 150–152 are substantially similar, only pad devices 150 will be considered in greater detail. Pad device 150 is an elongated block of resilient, compressible material having a length substantially equal to width X somewhat larger than distance D, and a depth somewhat greater than the depth of the opening 35. In this regard, the pad 150 is dimensioned so that pad device 150 substantially fills the space 26 and extends outwardly slightly therefrom by a distance of between about ½" to about 3/4.

During insertion, pad device 150 is urged into space 26, where the converging walls 30,31 frictionally secure the pad device 150. If desired, such as for cleaning purposes, pad device 150 may be removed, reoriented, and reinserted.

Considering now the base member 20 in still greater detail, the flexible strap members 141 and 142 are integrally connected to the respective left edge 23 and right edge 24 of the front wall 22. The members 141 and 142 extend outwardly from the edges 23, 24 and terminate at left and right distal ends 143, 144 respectively. A set of openings 145, 146 are provided in distal ends 143 and 144, respectively, to receive the belt 19 which can be passed through both openings 145,146 and around the user. In this manner, the device 12 is fastened to the user 9.

As best seen in FIG. 6, in performing a second exercise routine, the flat top member 160 of the platform structure 14 is separated from the legs 182–184 and placed on the floor 8 approximately one foot from the wall 6. The top member 160 is oriented so that the forward edge 166 is positioned toward the wall 6. With the top member 160 so positioned, the user engages member 160 by placing his or her right and left feet 200, 202 on foot engageable portions 163 and 164, respectively, so that the balls of the feet rest on the top surface 161 while the heels of the feet extend out away from member 160, overhanging the front edge portion 166.

After engaging the exercise device 12 with the wall 6, the user then alternately raises and lowers his or her heels about the member 160 to physically condition the leg muscles of the user.

A third exercise routine utilizing the exercise device 12 is best seen in FIG. 7. The user 9 stands next to the wall 6, facing outward with the exercise device 12 in engagement with the wall 6. Users feet 200, 202 are placed in a V-shaped positions, wherein the heels of the user's feet 200, 202 are spaced from six to twelve inches apart. Center lines A and B of feet 200 and 202 respectively, form an angle C of about 50° and 100°, approximating the plié ballet position.

The user 9 then lowers and raises his or her body by extending and contracting the legs. In this way, the user 9 may exercise and tighten the gluteal muscles in the buttocks and the lateral quadriceps in the thighs.

As best seen in FIG. 8, in performing a fourth exercise routine, the user 9 stands next to the wall 6, facing outward with the exercise device 12 in engagement with the wall 6. User's feet 200, 202 are placed in an inverted V-shaped position, wherein the user 9 places his or her toes of each foot 200, 202 adjacent to one another and the heels away from one another. Center lines D and E of feet 200 and 202, respectively, form an angle F of about 45° therebetween.

The user 9 then lowers and raises his or her body by extending and contracting the legs. In this way, the inner thighs, outer calf, and gluteals are physically conditioned.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. An exercise kit, comprising:

a back engageable support adapted to be supported about the waist of a user;

a pair of cylindrical roller members mounted on one side of the back engageable support in a spaced apart manner and extending across substantially the entire width of said support to permit free rectilinear movement of the support in a vertical plane; and a platform structure having a flat top member for limiting the downward rectilinear movement of the user to a preselected height above the ground as said support travels along a vertical path of travel, said platform structure further including adjustable leg means for supporting said flat top member above the ground to enable the user to adjust said preselected height.

2. An exercise kit for use in cooperation with a vertical wall surface adjacent to a floor to condition leg muscles of a user, comprising:

rolling exerciser means for engaging rollably and bi-directionally the vertical wall surface, wherein said exerciser means is worn on a lower back area of the user to accomplish a first and a second exercise routine;

adjustable stand means for limiting the downward movement of the user during said first exercise routine, wherein said stand means rests on the floor below the user and adjacent to the vertical wall, extending upwardly from the floor to a predetermined height; and said stand means including a flat rigid member removably attached to a support means and positioned substantially parallel to the floor at said predetermined height, wherein said flat rigid member contacts periodically the user during said first exercise routine and said flat rigid member is detached from said stand means and placed on the floor spaced apart from the wall during said second exercise routine;

said flat rigid member having a top surface and a beveled forward edge portion sloping downwardly and away from said top surface; and said flat rigid member also having a tab member protruding outwardly from an intermediate portion of said forward edge portion to separate said forward edge portion into a left foot engageable portion and a right foot engageable portion for facilitating proper foot placement during said second exercise routine.

3. A method of using an exercise kit in cooperation with a vertical wall surface adjacent to a floor to condition leg muscles of a user, comprising:

engaging rollably and bi-directionally the vertical wall surface using a rolling exerciser means, wherein said exerciser means is worn on a lower back area of the user to accomplish a plurality of exercise routines;

limiting the downward movement of the user during a first exercise routine using an adjustable stand means, wherein said stand means rests on the floor below the user and adjacent to the vertical wall, extending upwardly from the floor to a predetermined height; and said stand means including a flat rigid member removably attached to a support means and positioned substantially parallel to the floor at said predetermined height, wherein said flat rigid member contacts periodically the user during said first exercise routine and said flat rigid member is detached from said stand means and placed on the floor spaced apart from the wall during a second exercise routine.

4. A method of using an exercise kit according to claim 3, further comprising:

detaching said flat rigid member from said stand means;

placing said flat rigid member on the floor adjacent to the wall, said flat rigid member being reoriented from its position on said stand means by 180 degrees about a vertical axis; and engaging said flat rigid member with feet of the user, wherein the user rotates the feet about said flat rigid member to perform said second exercise routine.

* * * * *